US010699892B2

(12) United States Patent
Okumura

(10) Patent No.: US 10,699,892 B2
(45) Date of Patent: Jun. 30, 2020

(54) TIME-OF-FLIGHT MASS SPECTROMETER

(71) Applicant: Shimadzu Corporation, Kyoto-shi, Kyoto (JP)

(72) Inventor: Daisuke Okumura, Osaka (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 19 days.

(21) Appl. No.: 15/512,156

(22) PCT Filed: Sep. 18, 2014

(86) PCT No.: PCT/JP2014/074625
§ 371 (c)(1),
(2) Date: Mar. 17, 2017

(87) PCT Pub. No.: WO2016/042632
PCT Pub. Date: Mar. 24, 2016

(65) Prior Publication Data

US 2017/0278691 A1 Sep. 28, 2017

(51) Int. Cl.
*H01J 49/40* (2006.01)
*H01J 49/06* (2006.01)

(52) U.S. Cl.
CPC ..... *H01J 49/401* (2013.01); *H01J 49/06* (2013.01); *H01J 49/40* (2013.01)

(58) Field of Classification Search
None
See application file for complete search history.

(56) References Cited

U.S. PATENT DOCUMENTS 6,285,027 B1 * 9/2001 Chernushevich ..... H01J 49/004 250/287
7,456,388 B2 11/2008 Loboda et al.
2005/0247872 A1 * 11/2005 Loboda ..... H01J 49/062 250/288
2008/0283742 A1 * 11/2008 Takeuchi ..... H01J 49/066 250/288

(Continued)

FOREIGN PATENT DOCUMENTS

JP 2002-184349 A 6/2002
JP 2010-170848 A 8/2010

OTHER PUBLICATIONS

Written Opinion for PCT/JP2014/074625 dated Oct. 21, 2014. [PCT/ISA/237].

*Primary Examiner* — Andrew Smyth
(74) *Attorney, Agent, or Firm* — Sughrue Mion, PLLC

(57) ABSTRACT

A voltage applied to an exit gate electrode forming a potential barrier and temporarily trapping ions within the inner space of the ion guide is higher than a voltage at an ion guide's exit end. A higher voltage is applied to the exit gate electrode for a lower m/z value of the measurement target ion, to push back the ion which has slowly moved along a potential gradient and reached the exit end of the ion guide. An ion having a lower m/z value is more likely to be located in a farther region from the exit end and forced to travel a longer distance when voltage applied to the exit gate electrode is lowered. A lower m/z value also means a higher travelling speed toward the orthogonal accelerator, whereby m/z dependency of the time required for travel from the ion guide to the orthogonal accelerator eventually becomes low.

12 Claims, 6 Drawing Sheets

(56) References Cited

U.S. PATENT DOCUMENTS

2010/0193684 A1* 8/2010 Mukaibatake ..... H01J 49/022
250/292
2011/0284738 A1* 11/2011 Berg ..... H01J 49/0072
250/283

* cited by examiner

TIME-OF-FLIGHT MASS SPECTROMETER

CROSS REFERENCE TO RELATED APPLICATIONS

This application is a National Stage of International Application No. PCT/JP2014/074625, filed on Sep. 18, 2014, the contents of all of which are incorporated herein by reference in their entirety.

TECHNICAL FIELD

The present invention relates to a time-of-flight mass spectrometer (which is hereinafter abbreviated as "TOFMS"), and more specifically to an orthogonal acceleration TOFMS as well as an ion trap TOFMS in which ions are temporarily trapped in an ion trap and subsequently ejected from the ion trap into a flight space.

BACKGROUND ART

Normally, in a TOFMS, a certain amount of kinetic energy is imparted to an ion derived from a sample component to make the ion fly a distance within a space. The period of time required for the flight is measured, and the mass-to-charge ratio of the ion is calculated from the time of flight. Therefore, if there is a variation in the position of the ions and/or the amount of initial energy of the ions when ions are accelerated and begin their flight, the ions having the same mass-to-charge ratio will vary in their times of flight, which leads to a deterioration in the mass-resolving power or mass accuracy. One commonly known technique for solving this problem is the orthogonal acceleration TOFMS (which is also called the "perpendicular acceleration" or "orthogonal extraction" TOFMS) in which the ions to be sent into the flight space are accelerated in an orthogonal direction to the incident direction of the ion beam.

Meanwhile, in recent years, for the identification or structural analysis of substances having high molecular weights or substances having complex chemical structures, an $MS^n$ analysis (which is also called the "tandem analysis") has been commonly used, in which an ion having a specific mass-to-charge ratio is dissociated in one or more stages by a collision induced dissociation or similar technique, and the thereby generated product ions are mass-analyzed. Commonly known types of mass spectrometers capable of an $MS^n$ analysis are as follows: a triple quadrupole mass spectrometer, which includes two quadrupole mass filters placed before and after a collision cell for dissociating ions which contains a quadrupole ion guide (or multipole ion guide with a different number of poles); an ion trap mass spectrometer, which uses an ion trap having the function of separating ions according to their mass-to-charge ratios as well as the function of performing the dissociation operation on the ions; and an ion trap time-of-flight mass spectrometer, in which the aforementioned type of ion trap is combined with a TOFMS.

A quadrupole time-of-flight mass spectrometer (which is hereinafter called the "Q-TOFMS" according to a convention), which includes a quadrupole mass filter and orthogonal acceleration TOFMS respectively placed before and after a collision cell in order to make use of the high capability of the orthogonal acceleration TOFMS, is also commonly known.

FIG. 10A is a schematic configuration diagram of a collision cell and orthogonal accelerator in a Q-TOFMS described in Patent Literature 1. FIG. 10B is a diagram showing the potential distribution on the axis C (which in the present case is the ion beam axis) in FIG. 10A. FIG. 10C is a timing chart of the voltage applied to the exit gate electrode in FIG. 10A and the orthogonal acceleration voltage.

As shown in FIG. 10A, this Q-TOFMS is provided with an ion guide 51 within the collision cell 50 which dissociates ions. This ion guide 51, in conjunction with the entrance gate electrode 52 and the exit gate electrode 53 placed before and after itself, constitutes a linear ion trap. In this example, each of the entrance and exit gate electrodes 52 and 53 doubles as the entrance end face or exit end face, respectively.

A precursor ion having a specific mass-to-charge ratio selected in a quadrupole mass filter (not shown) is dissociated in the collision cell 50, with the potentials at the entrance and exit gate electrodes 52 and 53 increased to higher levels than the potential at the ion guide 51 so as to temporarily trap the generated product ions (and precursor ions which have not been dissociated) within the inner space of the ion guide 51. At a later point in time, the voltage applied to the exit gate electrode 53 is temporarily lowered so that the ions which have been trapped until that point in time are released from the collision cell 50 at a predetermined timing. The released ions are introduced through the grid electrode 54 and the skimmer 55 into the orthogonal accelerator 56 of the orthogonal acceleration TOFMS along the X axis. When an acceleration voltage is applied to the orthogonal accelerator 56 at a predetermined timing, the ions are accelerated in the Z-axis direction and introduced into the flight space (not shown).

The solid line in FIG. 10B represents the potential distribution when ions are trapped within the inner space of the ion guide 51. In this situation, since the potential at the exit gate electrode 53 is higher than the potential at the ion guide (rod electrodes) 51, ions moving toward the exit gate electrode 53 are pushed back and trapped within the collision cell 50. The broken line in FIG. 10B represents the potential distribution when the voltage applied to the exit gate electrode 53 is lowered. In this situation, the potential slopes from the exit end of the collision cell 50 down to the orthogonal accelerator 56, whereby the ions which have been trapped until that point in time are accelerated toward the orthogonal accelerator 56.

Although the ions having various mass-to-charge ratios trapped within the inner space of the ion guide 51 are almost simultaneously released from the ion guide 51, the ions become spread in their travelling direction (i.e. in the X-axis direction) before they reach the orthogonal accelerator 56. That is to say, the ions are given approximately equal amounts of acceleration energy, which means that an ion having a lower mass-to-charge ratio travels at a higher speed. Therefore, an ion having a lower mass-to-charge ratio reaches the orthogonal accelerator 56 earlier, followed by other ions arriving at the orthogonal accelerator 56 while being delayed in ascending order of their mass-to-charge ratios.

In the orthogonal accelerator 56, an acceleration voltage (which is called the "push-pull voltage" in Patent Literature 1) is applied at a predetermined timing. Only the ions which are passing through the orthogonal accelerator 56 when the acceleration voltage is applied are accelerated toward the flight space; the other ions are wasted. The rate of use of these ions is called the "duty cycle", which is defined as follows (for example, see Patent Literature 2):

$$\text{Duty Cycle [\%]}=\{(\text{amount of ions used for the measurement})/(\text{amount of ions which have reached the orthogonal accelerator})\}\times 100$$

The dissociation of the ions within the collision cell 50 produces ions having various mass-to-charge ratios. In the Q-TOFMS described in Patent Literature 1, in order to improve the duty cycle of the ions having a mass-to-charge ratio of interest, the delay time $t_D$ from the point in time $t_1$ where the pulsed voltage for releasing the ions from the collision cell 50 is applied to the point in time $t_2$ where the acceleration voltage is applied in the orthogonal accelerator 56 is adjusted according to the mass-to-charge ratio of the target ion to be subjected to the measurement (see FIG. 10C). In this operation, the acceleration voltage is applied at the timing when the ion which the analysis operator is paying attention to passes through the orthogonal accelerator 56. Therefore, the duty cycle for the target ion having the specific mass-to-charge ratio is improved, so that the detection sensitivity of the ion will also be improved.

However, the previously described Q-TOFMS has the following problems.

(1) In the previously described Q-TOFMS, when the mass-to-charge ratio of the ion for which the duty cycle should be improved is changed, it is necessary to accurately regulate the delay time $t_D$. Regulating the delay time of a pulsed signal at the levels of microseconds requires a high-precision delay line or similar element. However, such an element is expensive. Additionally, in the case where the operation of temporarily trapping the ions by the linear ion trap and performing a mass spectrometry on those ions by the TOFMS is repeated with a fixed cycle, i.e. at regular intervals of time, the control will be complex if the timing of the acceleration in the orthogonal accelerator 56 varies depending on the mass-to-charge ratio of the target ion.

(2) In the previously described Q-TOFMS, the duty cycle for ions other than the ion which the analysis operator is paying attention to becomes low (or those ions are practically almost undetectable). As in the MRM (multiple reaction ion monitoring) or precursor ion scan measurement, if the mass-to-charge ratio of the product ion to be monitored is fixed, the previously described Q-TOFMS is useful since only that specific product ion needs to be detected with a high level of sensitivity. However, the device does not allow the duty cycle to be simultaneously improved for a wide range of mass-to-charge ratios of the ions. Therefore, for example, as in the case of a product ion scan measurement or normal scan measurement which includes no fragmentation of the ion, if a mass spectrum covering a wide range of mass-to-charge ratios needs to be obtained, it is necessary to repeat the measurement a plurality of times with the mass-to-charge ratio range shifted each time.

A solution to the previously described problem (2) is a TOFMS described in Patent Literature 3. In this TOFMS, an ion guide having the function of trapping ions is axially divided into three segments so that a different voltage can be applied to each segment of the ion guide. Regulating the radio-frequency voltages applied to those segments of the ion guide changes the thereby created pseudo potential, making it possible to control the behavior of the trapped ions in each of the axial and radial directions. Accordingly, by appropriately changing the radio-frequency voltages according to the mass-to-charge ratio of the ion to be released, it is possible to make ions having different mass-to-charge ratios be individually released in a desired order and almost simultaneously arrive at a specific point in space.

However, this TOFMS requires the ion guide to be axially divided and additionally equipped with a power source capable of applying a different radio-frequency voltage to each segment of the ion guide. Furthermore, the sequence for changing the voltage according to the mass-to-charge ratio is complex.

Those problems are not unique to the Q-TOFMS; an ion trap time-of-flight mass spectrometer, in which the ions temporarily captured within a three-dimensional quadrupole ion trap are collectively ejected from the ion trap and mass-analyzed, has similar problems to those which occur in the previously described type of orthogonal acceleration TOFMS. In this type of mass spectrometers, if ions are spread in their travelling direction before they arrive at the ion injection hole of the ion trap, only the ions which arrive at the ion trap within a predetermined time range can be captured within the ion trap; the other ions are repelled at the ion injection hole or directly pass through the ion trap, without being used for the measurement. Therefore, if ions arrive at the ion injection hole of the ion trap in a temporally shifted form according to their mass-to-charge ratios, only the ions within a limited range of mass-to-charge ratios can be captured by the ion trap, so that it is impossible to perform the measurement for a wide range of mass-to-charge ratios of the ions with a high level of sensitivity.

CITATION LIST

Patent Literature

Patent Literature 1: U.S. Pat. No. 6,285,027 B
Patent Literature 2: JP 2010-170848 A
Patent Literature 3: U.S. Pat. No. 7,456,388 B
Patent Literature 4: JP 2002-184349 A

SUMMARY OF INVENTION

Technical Problem

To solve the aforementioned problem (1), it is necessary to create a system capable of controlling the mass-to-charge ratio of the ions accelerated by the orthogonal accelerator according to the mass-to-charge ratio of the target ion while maintaining the same length of delay time from the point in time where the ions are released from the collision cell to the point in time where the acceleration voltage is applied in the orthogonal accelerator. To solve the aforementioned problem (2), it is necessary to make ions having different mass-to-charge ratios almost simultaneously arrive at a desired point in space with a comparatively simple configuration and simple control process.

The present invention has been developed to solve these problems. Its first objective is to provide an orthogonal acceleration TOFMS or ion trap TOFMS with a simple configuration and control process for performing a measurement with a high level of sensitivity for ions having a mass-to-charge ratio of interest or included in a narrow mass-to-charge ratio range of interest. The second objective of the present invention is to provide an orthogonal acceleration TOFMS or ion trap TOFMS in which a measurement for a wide range of mass-to-charge ratios of the ions can be performed with a high level of sensitivity by widening the mass-to-charge ratio range of the ions to be used for the measurement in the TOFMS as well as decreasing the loss of those ions.

Solution to Problem

As in the Q-TOFMS described in Patent Literature 1, if the device is configured so that the ions as the measurement target are temporarily trapped within the inner space of the ion guide and subsequently released from the ion guide into the orthogonal accelerator, the period of time required for the ions to travel (fly) from the ion guide to the orthogonal accelerator depends on the initial position of the ions within the ion guide at the beginning of the travel, i.e. on the travel distance, in addition to the amount of energy given to the ions at the beginning of or during their travel. Under the condition that all ions receive the same amount of energy regardless of their mass-to-charge ratios, ions having lower mass-to-charge ratios travel at higher speeds. Accordingly, by shifting the initial position of such ions toward the front side (i.e. away from the orthogonal accelerator) within the ion guide, the period of time required for the travel can be equalized for all mass-to-charge ratios. Shifting the initial position of the ions is difficult if the ions are trapped in a small amount of space, as in the case of the three-dimensional quadrupole ion trap. By comparison, linear ion traps have a larger amount of space for trapping the ions than three-dimensional quadrupole ion traps and allow for the operation of controlling the ion-trapping position according to the mass-to-charge ratio of the ions as the measurement target so as to shift the initial position of the ions.

The present invention has been developed based on the above principle. The first aspect of the present invention aimed at achieving the first objective is an orthogonal acceleration time-of-flight mass spectrometer including an orthogonal accelerator for accelerating incident ions in an orthogonal direction to the axis of incidence of the ions and a separating-detecting section in which the accelerated ions are separated according to their mass-to-charge ratios and detected, the mass spectrometer further including:

a) an ion trap for temporarily trapping ions as a measurement target, including an ion guide for converging ions into an area near an ion beam axis by a radio-frequency electric field and an exit gate electrode placed on the outside of the exit end of the ion guide, with the ion guide having a potential distribution sloped downward in a travelling direction of the ions on the ion beam axis;

b) a voltage supplier for applying a DC voltage to the exit gate electrode; and c) a controller for controlling the voltage supplier in such a manner that a trapping DC voltage which is higher than at least the potential at the exit end of the ion guide is applied to the exit gate electrode while trapping the ions as the measurement target within the inner space of the ion guide, and a releasing DC voltage which is lower than the potential at the exit end of the ion guide is applied to the exit gate electrode at a time of releasing the ions from the ion guide, where the controller changes the trapping DC voltage according to the mass-to-charge ratio or mass-to-charge ratio range of the ions as the measurement target.

The second aspect of the present invention aimed at achieving the first objective is an orthogonal acceleration time-of-flight mass spectrometer including: an ion trap section for capturing incident ions by an effect of an electric field and subsequently imparting acceleration energy to the ions at a predetermined timing to eject the ions at substantially the same point in time; and a separating-detecting section in which the ions ejected from the ion trap section are separated according to their mass-to-charge ratios and detected, the mass spectrometer further including:

a) an ion trap for temporarily trapping ions as a measurement target, including an ion guide for converging ions into an area near an ion beam axis by a radio-frequency electric field and an exit gate electrode placed on the outside of the exit end of the ion guide, with the ion guide having a potential distribution sloped downward in a travelling direction of the ions on the ion beam axis;

b) a voltage supplier for applying a DC voltage to the exit gate electrode; and c) a controller for controlling the voltage supplier in such a manner that a trapping DC voltage which is higher than at least the potential at the exit end of the ion guide is applied to the exit gate electrode while trapping the ions as the measurement target within the inner space of the ion guide, and a releasing DC voltage which is lower than the potential at the exit end of the ion guide is applied to the exit gate electrode at a time of releasing the ions from the ion guide, where the controller changes the trapping DC voltage according to the mass-to-charge ratio or mass-to-charge ratio range of the ions as the measurement target.

The third aspect of the present invention aimed at achieving the second objective is an orthogonal acceleration time-of-flight mass spectrometer including an orthogonal accelerator for accelerating incident ions in an orthogonal direction to the axis of incidence of the ions and a separating-detecting section in which the accelerated ions are separated according to their mass-to-charge ratios and detected, the mass spectrometer further including:

a) an ion trap for temporarily trapping ions as a measurement target, including an ion guide for converging ions into an area near an ion beam axis by a radio-frequency electric field and an exit gate electrode placed on the outside of the exit end of the ion guide, with the ion guide having a potential distribution sloped downward in a travelling direction of the ions on the ion beam axis;

b) a voltage supplier for applying a DC voltage to the exit gate electrode; and c) a controller for controlling the voltage supplier in such a manner that, while trapping the ions as the measurement target within the inner space of the ion guide, a trapping DC voltage which is higher than at least the potential at the exit end of the ion guide is applied to the exit gate electrode, the DC voltage applied to the exit gate electrode is changed for a predetermined period of time so as to increase the potential at the exit gate electrode before releasing the ions from the ion guide, and subsequently, a releasing DC voltage which is lower than the potential at the exit end of the ion guide is applied to the exit gate electrode.

The fourth aspect of the present invention aimed at achieving the second objective is an orthogonal acceleration time-of-flight mass spectrometer including: an ion trap section for capturing incident ions by an effect of an electric field and subsequently imparting acceleration energy to the ions at a predetermined timing to eject the ions at substantially the same point in time; and a separating-detecting section in which the ions ejected from the ion trap section are separated according to their mass-to-charge ratios and detected, the mass spectrometer further including:

a) an ion trap for temporarily trapping ions as a measurement target, including an ion guide for converging ions into an area near an ion beam axis by a radio-frequency electric field and an exit gate electrode placed on the outside of the exit end of the ion guide, with the ion guide having a potential distribution sloped downward in a travelling direction of the ions on the ion beam axis;

b) a voltage supplier for applying a DC voltage to the exit gate electrode; and c) a controller for controlling the voltage supplier in such a manner that, while trapping the ions as the measurement target within the inner space of the ion guide, a trapping DC voltage which is higher than at least the potential at the exit end of the ion guide is applied to the exit gate electrode, the DC voltage applied to the exit gate electrode is changed for a predetermined period of time so as to increase the potential at the exit gate electrode before releasing the ions from the ion guide, and subsequently, a releasing DC voltage which is lower than the potential at the exit end of the ion guide is applied to the exit gate electrode.

In any of the time-of-flight mass spectrometers according to the first through fourth aspects of the present invention, the ions as the measurement target are temporarily trapped within the inner space of the ion guide of the ion trap and subsequently released from the ion trap into the orthogonal accelerator or ion trap section. While trapping the ions, a predetermined level of DC voltage (trapping DC voltage) is applied to the exit gate electrode so that the potential at the position of the exit gate electrode is higher than the potential at the exit end of the ion guide. By this operation, a potential barrier is formed between the exit end of the ion guide and the exit gate electrode, whereby the ions attempting to move beyond the exit end of the ion guide to the outside are pushed back into the ion guide.

Meanwhile, due to the DC voltages applied to the ion guide, a potential distribution which slopes down in the travelling direction of the ions on the ion beam axis is formed within the inner space of the ion guide. Therefore, when an ion pushed back toward the entrance end by the potential barrier at the exit end of the ion guide returns to an area near the position corresponding to the amount of the push-back energy, the ion loses its kinetic energy and turns its direction to move once more toward the exit end along the downward slope of the potential distribution. The higher the potential barrier is, the greater the energy to push back the ion is, and the closer the ion is pushed back to the front end on the ion beam axis within the inner space of the ion guide.

Accordingly, in the time-of-flight mass spectrometer according to the first or second aspect of the present invention, the trapping DC voltage corresponding to the mass-to-charge ratio of the target ion is applied to the exit gate electrode so that a higher potential barrier is formed for a target ion having a lower mass-to-charge ratio. As a result, an ion having a lower mass-to-charge ratio becomes more likely to be located closer to the front end within the inner space of the ion guide, i.e. at an initial position which corresponds to a longer travel distance. The relationship between the mass-to-charge ratio of the ion and the trapping DC voltage which is suitable for the ion can be previously determined by an experiment or simulation.

Although the ions trapped within the inner space of the ion guide do not completely stand still near specific positions, the previously described control of the trapping DC voltage affects the ions so that each kind of ion tends to gather near a specific initial position which depends on the mass-to-charge ratio of the ion. Therefore, when the releasing DC voltage is applied to the exit gate electrode to release those ions, a portion or most of the target ions begin their travel from their respective initial positions that are suitable for realizing a specific length of the travel time, and those target ions are duly introduced into the orthogonal accelerator or ion trap after the passage of that specific length of the travel time. As a result, for example, the mass-to-charge ratio or mass-to-charge ratio range of the ions for which a high level of duty cycle is achieved can be freely changed while maintaining the same length of delay time from the point in time where the ions are released from the ion guide to the point in time where the acceleration voltage is applied in the orthogonal accelerator to send the ions into the flight space.

In the time-of-flight mass spectrometer according to the first or second aspect of the present invention, the controller may preferably be configured to additionally change the releasing DC voltage according to the mass-to-charge ratio or mass-to-charge ratio range of the ions as the measurement target.

With this configuration, the period of time required for an ion which has left the inner space of the ion guide to pass by the exit end electrode can be regulated. Therefore, by appropriately determining the releasing DC voltage according to the mass-to-charge ratio or mass-to-charge ratio range of the target ion, the point in time where the ion reaches the orthogonal accelerator or ion trap can be more accurately controlled. Consequently, the duty cycle for the target ion can be even further improved.

On the other hand, in the time-of-flight mass spectrometer according to the third or fourth aspect of the present invention, immediately before the ions trapped within the inner space of the ion guide are released, the controller changes the DC voltage applied to the exit gate electrode for a predetermined period of time so that the potential at the exit gate electrode becomes higher than the previous level. In other words, the ions are given a greater amount of energy than the previous level while being pushed back. As noted earlier, an ion having a lower mass-to-charge ratio is pushed back closer to the front end within the inner space of the ion guide. Therefore, by appropriately determining the value of the DC voltage for pushing the ions and the period of time to apply this voltage (i.e. the aforementioned "predetermined period of time"), it is possible to push back each ion included within a certain wide range of mass-to-charge ratios to an area near the initial position from which the ion can achieve a specific length of the travel time. With each ion pushed back in this manner, the voltage applied to the exit gate electrode is changed to the releasing DC voltage, whereupon each of the ions having various mass-to-charge ratios starts from an area near the initial position from which the ion can achieve a specific length of the travel time, so that the ions almost simultaneously reach the orthogonal accelerator or ion trap.

As a result, in the time-of-flight mass spectrometer according to the third aspect, a wide range of mass-to-charge ratios of the ions can be accelerated in the orthogonal accelerator and sent into the flight space. Therefore, it is possible to obtain intensity information of the ions over a wide range of mass-to-charge ratios with a single measurement. In the time-of-flight mass spectrometer according to the fourth aspect, a wide range of mass-to-charge ratios of the ions can be efficiently captured in the ion trap. Therefore, similarly to the third embodiment, it is possible to obtain intensity information of the ions over a wide range of mass-to-charge ratios with a single measurement.

In the time-of-flight mass spectrometer according to the present invention, in order for the ion guide to have a potential distribution which slopes down in the travelling direction of the ions on the ion beam axis, it is preferable, for example, to arrange the rod electrodes constituting the ion guide in an inclined form with respect to the ion beam axis, instead of arranging them parallel to the ion beam axis, so that the distance between the ion beam axis and the inner circumferential surface of the rod electrodes in an orthogonal plane to the ion beam axis gradually increases as the plane moves in the travelling direction of the ions. Such a method is commonly known. It is also possible to use another method disclosed in Patent Literature 3.

Advantageous Effects of the Invention

In the time-of-flight mass spectrometer according to the first aspect of the present invention, the mass-to-charge ratio or mass-to-charge ratio range of the ions for which a high level of duty cycle is achieved can be freely changed without altering the delay time from the point in time where the ions are released from the ion guide to the point in time where the acceleration voltage is applied in the orthogonal accelerator. Therefore, ions having a specific mass-to-charge ratio or included in a narrow specific mass-to-charge ratio range can be detected with a high level of sensitivity by a simple configuration and control process.

In the time-of-flight mass spectrometer according to the second aspect of the present invention, the mass-to-charge ratio or mass-to-charge ratio range of the ions for which a high level of ion-capturing efficiency is achieved can be freely changed without altering the delay time from the point in time where the ions are released from the ion guide to the point in time where the ions are captured by the ion trap. Therefore, as with the first aspect, ions having a specific mass-to-charge ratio or included in a narrow specific mass-to-charge ratio range can be detected with a high level of sensitivity by a simple configuration and control process.

In the time-of-flight mass spectrometer according to the third aspect of the present invention, a wide range of mass-to-charge ratios of the ions can be accelerated by the orthogonal accelerator and subjected to a mass spectrometry with no waste. In other words, the duty cycle can be improved for a wide range of mass-to-charge ratios of the ions, so that a high-sensitivity mass spectrum covering a wide range of mass-to-charge ratios can be obtained with a single measurement.

In the time-of-flight mass spectrometer according to the fourth aspect of the present invention, a wide range of mass-to-charge ratios of the ions can be captured in the ion trap section and subjected to a mass spectrometry with no waste. Accordingly, as with the time-of-flight mass spectrometer according to the third aspect, a high-sensitivity mass spectrum covering a wide range of mass-to-charge ratios can be obtained with a single measurement.

DESCRIPTION OF EMBODIMENTS

A Q-TOFMS as the first embodiment of the present invention is hereinafter described with reference to the attached drawings.

Figure 1:
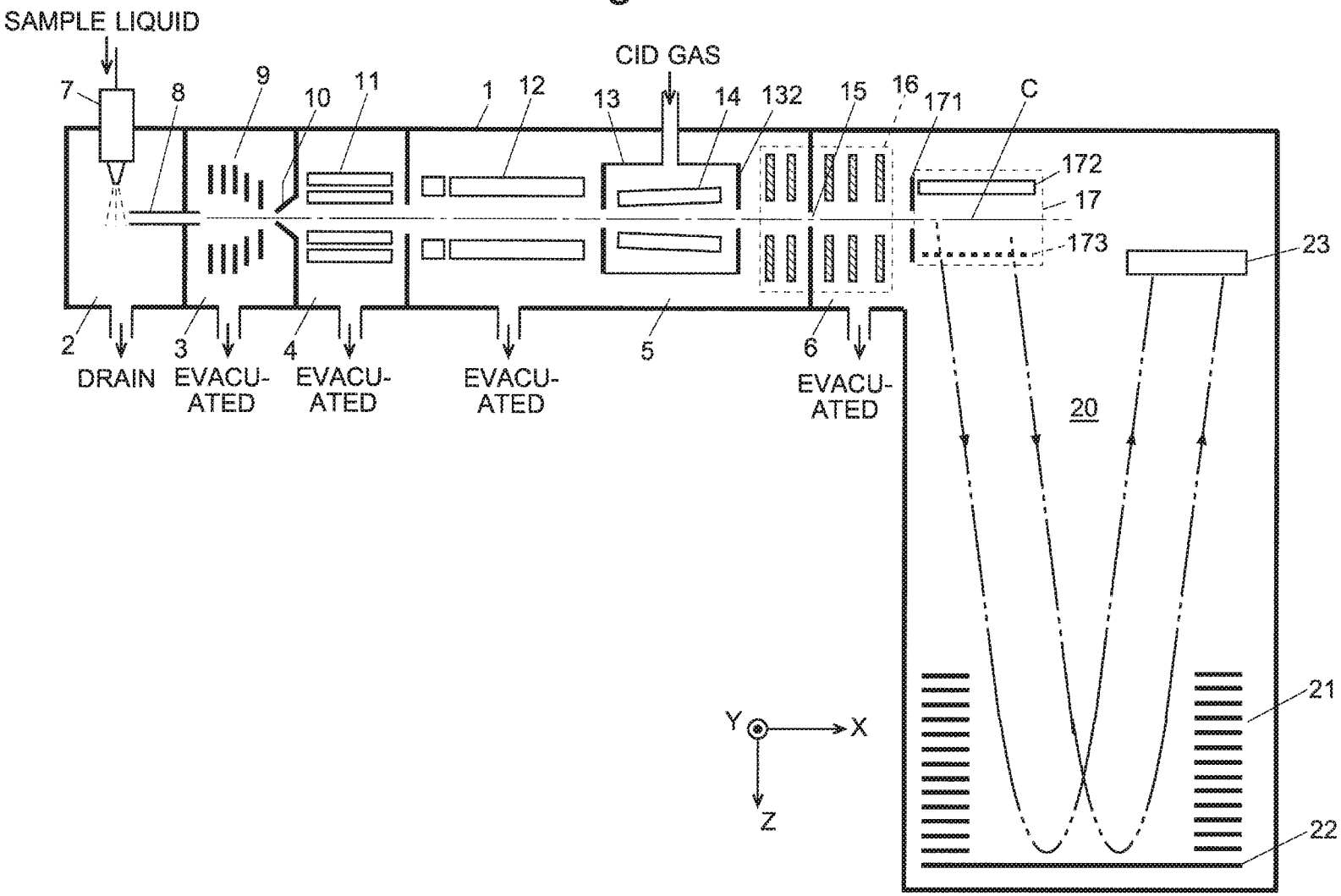
FIG. 1 is an overall configuration diagram of a Q-TOFMS as the first embodiment of the present invention.

FIG. 1 is an overall configuration diagram of the Q-TOFMS of the first embodiment. The Q-TOFMS of the present embodiment has the configuration of a multi-stage differential pumping system including an ionization chamber 2 maintained at substantially atmospheric pressure and a high-vacuum chamber 6 evacuated to the highest degree of vacuum, between which three chambers, named the first through third intermediate vacuum chambers 3, 4 and 5, are provided within a chamber 1.

The ionization chamber 2 is provided with an ESI spray device 7 for electrospray ionization (ESI). When a sample liquid containing a target compound is supplied to the ESI spray device 7, ions originating from the target compound are generated from the droplets which have been given imbalanced electric charges and sprayed from the tip of the spray device 7. It should be noted that the ionization method is not limited to this technique. For example, if the sample is a liquid, an atmospheric pressure ionization method different from the ESI can be used, such as APCI or PESI. If the sample is in a solid form, the MALDI or similar method can be used. For a gasified sample, the EI or similar method is available.

The generated various ions are sent through a heated capillary 8 into the first intermediate vacuum chamber 3, where the ions are converged by an ion guide 9 and sent through a skimmer 10 into the second intermediate vacuum chamber 4. The ions are further converged by an octapole ion guide 11 and sent into the third intermediate vacuum chamber 5. The third intermediate vacuum chamber 5 contains a quadrupole mass filter 12 and a collision cell 13 within which a quadrupole ion guide 14 functioning as the linear ion trap is provided. The various ions derived from the sample are introduced into the quadrupole mass filter 12, where only an ion having a specific mass-to-charge ratio corresponding to the voltage applied to the quadrupole mass filter 12 travels through this filter. This ion is introduced into the collision cell 13 as the precursor ion. Due to a collision with a CID gas supplied from an external source into the collision cell 13, the precursor ion is dissociated and various product ions are thereby generated.

The ion guide 14 functions as a linear ion trap. The generated product ions are temporarily trapped within the inner space of the ion guide 14. At a predetermined timing, the trapped ions are released from the collision cell 13. Being guided by an ion transport optical system 16, the ions are introduced through an ion passage opening 15 into the high-vacuum chamber 6. The ion transport optical system 16 lies in both the third intermediate vacuum chamber 5 and the high-vacuum chamber 6 across the ion passage opening 15. The high-vacuum chamber 6 contains an orthogonal accelerator 17 serving as the ion ejection source, a flight space 20 provided with a reflector 21 and back plate 22, as well as an ion detector 23. The ions introduced into the orthogonal accelerator 17 along the X axis are accelerated in the Z-axis direction at a predetermined timing and begin to fly. The ions initially fly freely and are then repelled by a reflecting electric field created by the reflector 21 and back plate 22. Subsequently, the ions once more fly freely and eventually reach the ion detector 23. The time of flight from the point in time where an ion leaves the orthogonal accelerator 17 to the point in time where it arrives at the ion detector 23 depends on the mass-to-charge ratio of the ion. Accordingly, a data processor (not shown), which receives detection signals from the ion detector 23, calculates the mass-to-charge ratio of each ion based on its time of flight and creates, for example, a mass spectrum.

Figure 2A:
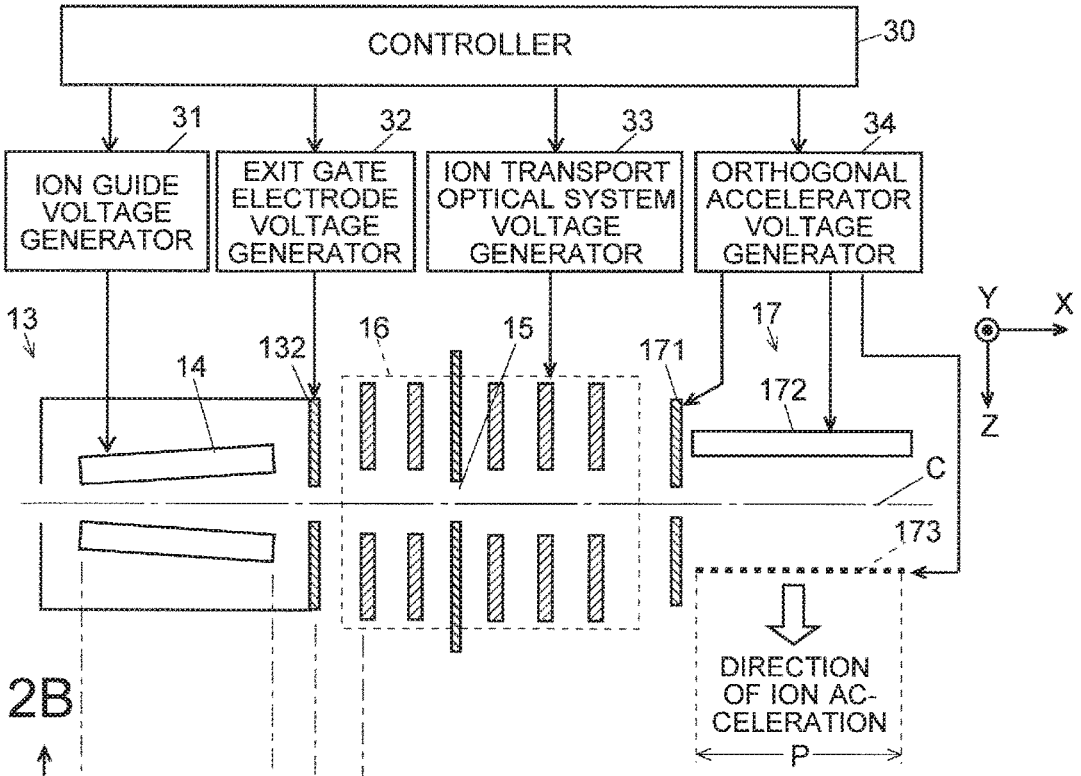
FIG. 2A is a detailed configuration diagram of the section between the collision cell and the orthogonal accelerator in FIG. 1.
Figure 2B:
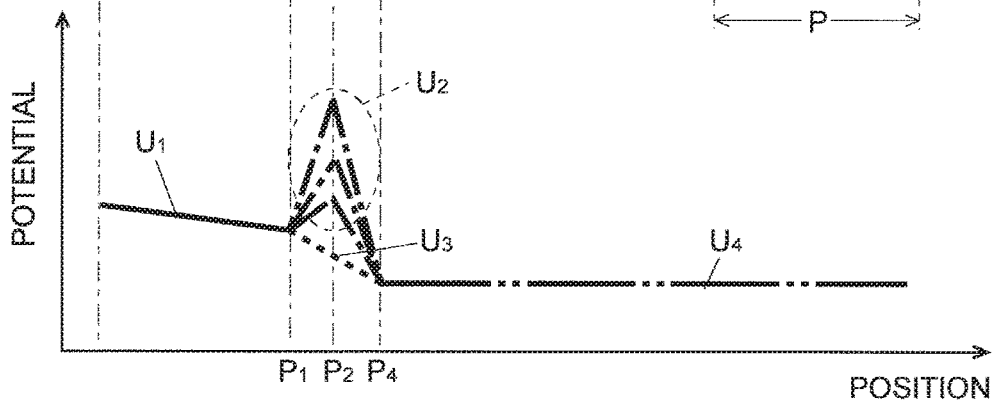
FIG. 2B is a schematic diagram of the potential distribution on the axis C.

FIG. 2A is a detailed configuration diagram of the section between the collision cell 13 and the orthogonal accelerator 17 in FIG. 1, and FIG. 2B is a schematic diagram of the potential distribution on the axis C (which in the present case is the ion beam axis).

The ion guide 14 consists of four rod electrodes. As shown in FIG. 2A, these four rod electrodes (it should be noted that only two rod electrodes placed in the Z-axis direction across the axis C are shown in FIG. 2A) are not parallel to the axis C; they are arranged in an inclined form so that their distance from the axis C gradually increases in the travelling direction of the ions (in the figure, rightward). The rear end face of the collision cell 13 serves as the exit gate electrode 132. This exit gate electrode 132 and the ion guide 14 effectively function as the linear ion trap.

The ion transport optical system 16 is composed of a plurality of (in this example, five) disc-shaped plate electrodes arrayed along the axis C, each of which has a circular opening at its center. The orthogonal accelerator 17 includes an entrance electrode 171, pushing electrode 172 and grid-like extracting electrode 173. Under the command of a controller 30, an ion guide voltage generator 31 applies a predetermined voltage to each rod electrode of the ion guide 14, an exit gate electrode voltage generator 32 applies a predetermined voltage to the exit gate electrode 132, an ion transport optical system voltage generator 33 applies a predetermined voltage to each plate electrode included in the ion transport optical system 16, and an orthogonal accelerator voltage generator 34 applies predetermined voltages to the entrance electrode 171, pushing electrode 172 and extracting electrode 173, respectively.

Figure 3A:
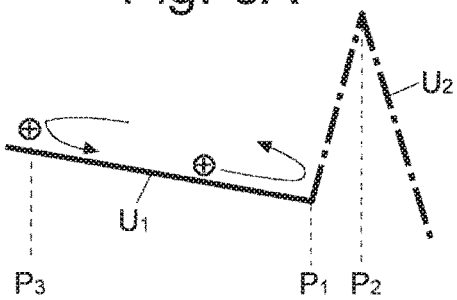
FIGS. 3A and 3B are diagrams illustrating the behavior of an ion within the inner space of the ion guide in the Q-TOFMS of the first embodiment.
Figure 3B:
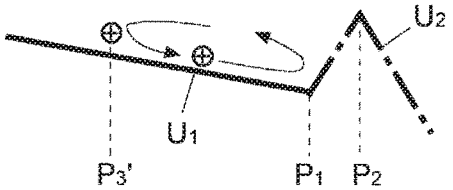

In the Q-TOFMS of the present embodiment, the product ions generated by fragmenting an ion introduced into the collision cell 13 are temporarily trapped within the inner space of the ion guide 14. Then, the trapped ions are ejected from the collision cell 13 and introduced through the ion transport optical system 16 into the orthogonal accelerator 17 for mass spectrometry. The operation of this process is hereinafter described with reference to FIGS. 3A and 3B as well as FIGS. 2A and 2B. FIGS. 3A and 3B are diagrams illustrating the behavior of an ion within the inner space of the ion guide 14. It should be noted that the present example is the case where the measurement target ion is a positive ion. It is evident that the polarity of each voltage only needs to be reversed when the measurement target ion is a negative ion.

When ions are trapped within the inner space of the ion guide 14, the ion guide voltage generator 31 applies, to each of the four rod electrodes constituting the ion guide 14, a voltage generated by adding a radio-frequency voltage and a DC voltage. The radio-frequency voltage serves to form a quadrupole radio-frequency electric field which focuses the ions into an area near the ion beam axis C, while the DC voltage mainly serves to form a potential distribution along the ion beam axis C. In this stage, the exit gate electrode voltage generator 32 applies, to the exit gate electrode 132, a predetermined level of DC voltage that is higher than the voltage at the exit end of the ion guide 14.

The solid line $U_1$ in FIG. 2B schematically represents the potential distribution on the ion beam axis C within the inner space of the ion guide 14 when ions are trapped within the same inner space. When the aforementioned voltages are applied, the potential distribution within the inner space of the ion guide 14 gently slopes from the entrance end down to the exit end. Meanwhile, as shown by a plurality of single-dotted chain lines $U_2$ in FIG. 2B, the potential at the exit gate electrode 132 is higher than the potential at the exit end of the ion guide 14, whereby a potential barrier is formed between the exit end (located at point $P_1$ in FIG. 2B) of the ion guide 14 and the exit gate electrode 132 (located at point $P_2$ in FIG. 2B).

Due to the gentle downward slope of the potential distribution formed within the inner space of the ion guide 14, the ions trapped within the ion guide 14 move in the travelling direction of the ions (rightward in FIGS. 2A and 2B). Upon reaching the exit end of the ion guide 14, the ions are pushed back by the potential barrier. The controller 30 controls the exit gate electrode voltage generator 32 so that the voltage applied to the exit gate electrode 132 is changed according to the mass-to-charge ratio of the measurement target ion. Specifically, a higher level of voltage is applied to the exit gate electrode 132 for a lower mass-to-charge ratio of the measurement target ion. By this operation, a higher potential barrier is formed for a lower mass-to-charge ratio of the measurement target ion. The plurality of single-dotted chain lines $U_2$ in FIG. 2B represent potential barriers with different heights.

FIG. 3A conceptually shows the behavior of an ion in the case where a high potential barrier is formed, i.e. when the mass-to-charge ratio of the ion is comparatively low, while FIG. 3B conceptually shows that of an ion in the case where a low potential barrier is formed, i.e. when the mass-to-charge ratio of the ion is comparatively high.

The ion pushed by the potential barrier ascends the potential slope indicated by the solid line $U_1$ to a point where its kinetic energy becomes zero. Upon reaching this point, the ion turns its direction and once more descends the potential slope. As shown in FIG. 3A, a higher potential barrier has a steeper slope of the barrier and a greater amount of force to push back the ion, so that the pushed ion returns to a farther position (indicated by point $P_3$) from the exit end of the ion guide 14. By comparison, when the potential barrier is low as shown in FIG. 3B, the barrier has a gentler slope and a smaller amount of force to push back the ion, so that the pushed ion returns no farther than a closer position (indicated by point $P_3'$) to the exit end of the ion guide 14.

In other words, by changing the voltage applied to the exit gate electrode 132 in the previously described manner according to the mass-to-charge ratio of the measurement target ion, it is possible to make ions with lower mass-to-charge ratios tend to gather at closer positions to the entrance end of the ion guide 14 within the inner space of the ion guide 14, and to make ions with higher mass-to-charge ratios tend to gather at farther positions from the exit end of the ion guide 14 within the inner space of the ion guide 14. In this manner, when ions are trapped within the inner space of the ion guide 14, the location where the ions tend to gather is changed according to their mass-to-charge ratio. Subsequently, at a predetermined timing, the exit gate electrode voltage generator 32 lowers the voltage applied to the exit gate electrode 132 to a level that is lower than the voltage at the exit end of the ion guide 14 and yet higher than the voltage applied to the first plate electrode of the ion transport optical system 16. The broken line $U_3$ in FIG. 2B schematically represents the potential distribution between the exit end of the ion guide 14 and the first plate electrode of the ion transport optical system 16 in this situation.

As shown in FIG. 2B, the potential barrier no longer exists and a potential gradient sloping from the exit end of the ion guide 14 down to the ion transport optical system 16 is formed, so that the ions trapped within the inner space of the ion guide 14 are simultaneously released toward the ion transport optical system 16. The starting point (initial position) from which the ions begin to move within the inner space of the ion guide 14 toward the ion transport optical system 16 varies depending on the mass-to-charge ratios of the ions; roughly speaking, the starting point for an ion having a lower mass-to-charge ratio is located at a farther position from the exit end of the ion guide 14. The released ions travel through the ion transport optical system 16 to the orthogonal accelerator 17, where an ion having a lower mass-to-charge ratio needs to travel a longer distance to reach the orthogonal accelerator 17.

In order to transport the ions through the ion transport optical system 16 while converging them into an area near the ion beam axis C, a different level of voltage is applied from the ion transport optical system voltage generator 33 to each plate electrode included in the ion transport optical system 16. Therefore, the potentials at the positions of where the plate electrodes are located are not exactly the same. However, the potential on average can be considered as constant. Accordingly, in FIG. 2B, the potential distribution is indicated by the double-dotted chain line $U_4$.

The ions moving toward the orthogonal accelerator 17 gain most of their kinetic energy from the accelerating electric field formed within the space between the exit end of the ion guide 14 and the first plate electrode of the ion transport optical system 16. Provided that the amount of this energy is always the same, the moving speed of each ion depends on its mass-to-charge ratio; i.e. the lower the mass-to-charge ratio is, the higher the speed becomes. On the other hand, an ion having a lower mass-to-charge ratio has a longer travel distance. Therefore, an ion traveling faster than an ion having a higher mass-to-charge ratio will eventually have only a small difference in the terms of the time required to reach the orthogonal accelerator 17. This fact is hereinafter described using a simulation result.

Figure 4:
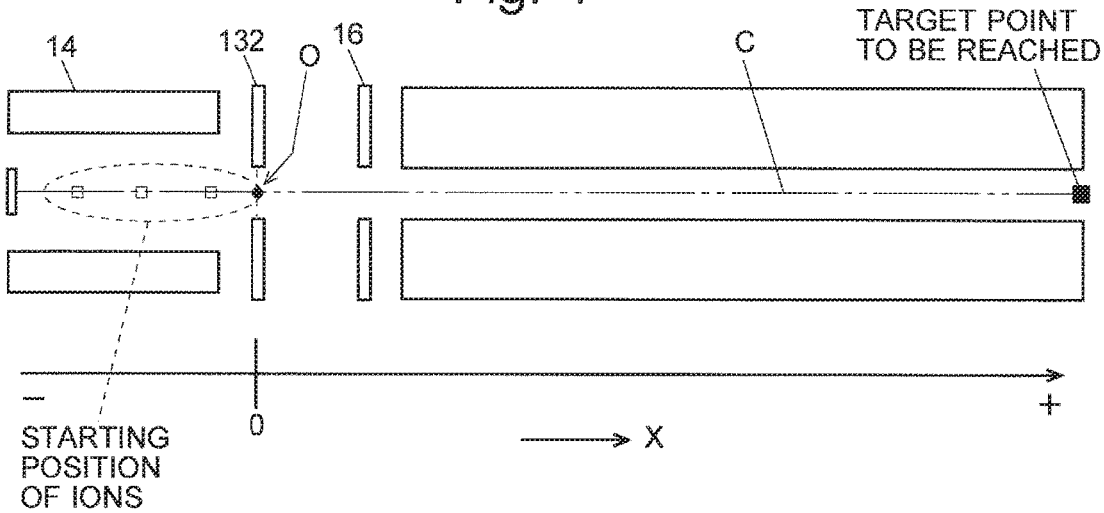
FIG. 4 is a configuration diagram assumed in a simulation calculation of the motion of an ion in the Q-TOFMS of the first embodiment.
Figure 5:
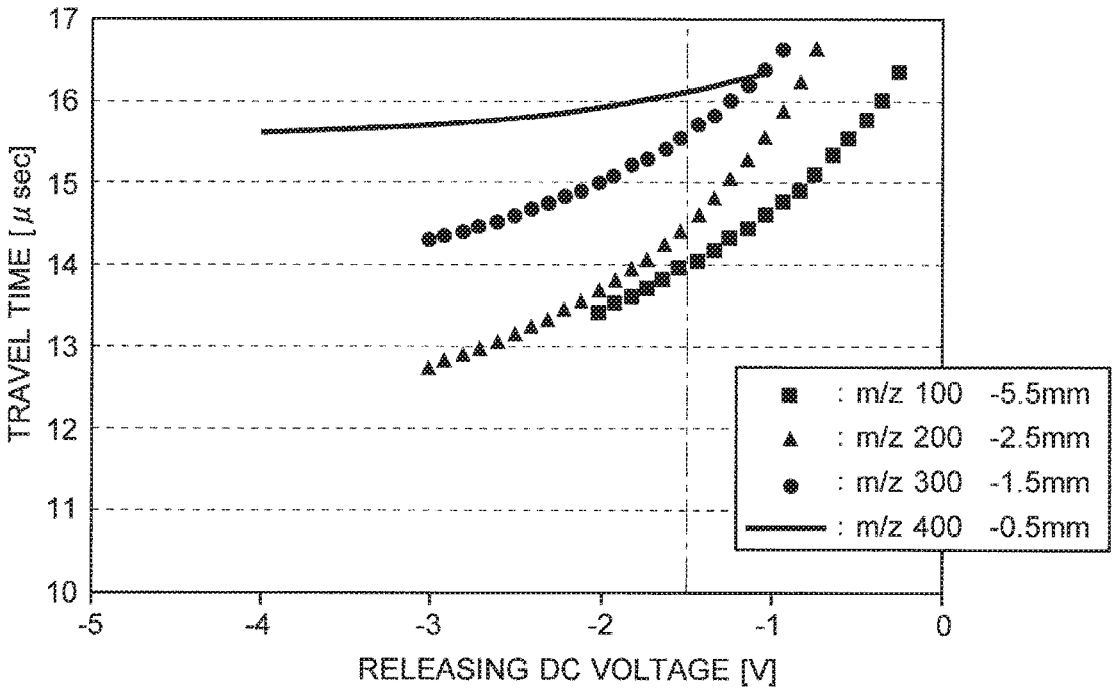
FIG. 5 is a chart showing the result of a simulation of the relationship between the releasing DC voltage and the travel time, with the initial position of the ion changed according to the mass-to-charge ratio.

FIG. 4 is a model configuration diagram assumed in a simulation calculation of the motion of the ion in the Q-TOFMS of the first embodiment. FIG. 5 is a chart showing the result of the simulation of the relationship between the releasing DC voltage (the voltage applied to the exit gate electrode 132 to release ions) and the travel time, with the initial position of the ion changed according to its mass-to-charge ratio. In the present example, the starting position of the ion is expressed in relation to the position of the exit gate electrode 132 as the reference point (zero), with the moving direction of the ions at the releasing point defined as positive and the opposite direction as negative. For example, the starting position of an ion with m/z 400 is located at 0.5 mm frontward from the exit gate electrode 132, while that of an ion having a lower mass-to-charge ratio, m/z 100, is located at 5.5 mm frontward from the exit gate electrode 132. Namely, the latter ion has a 5-mm longer travel distance than the former one.

For comparison, the travel time was also calculated for ions with m/z 100, m/z 200, m/z 300 and m/z 400 in the case where the ions were simply trapped within the inner space of the ion guide 14 before being released, i.e. under the condition that the ions were assumed to be located at almost the same position regardless of their mass-to-charge ratios when they were released. The result was 8.19037 usec, 11.5829 usec, 14.1861 usec and 16.3807 usec, respectively. On the other hand, as can be seen in FIG. 5, for example, when the releasing voltage is −1.5 V, the travel time of the ion with m/z 100 is approximately 14 usec, and the travel time of the ion with m/z 400 is approximately 16.1 usec. As compared to the result obtained under the condition that the ions were initially located at almost the same position, the range of the travel time was dramatically narrowed. This fact demonstrates that the travel time can be almost equalized by regulating the starting position of the ions according to their mass-to-charge ratios.

However, the change in the starting position of the ions also causes a change in the amount of energy given to the ions during their passage through the inner space of the ion guide 14. Therefore, it is difficult to accurately equalize the periods of time required for the travel of the ions having different mass-to-charge ratios by merely regulating the starting position of the ions. Therefore, it is preferable to additionally change the releasing DC voltage according to the mass-to-charge ratio of the measurement target ion. The result shown in FIG. 5 demonstrates that the travel time can be approximately equalized to 16 usec by setting the releasing DC voltage at approximately −1.8 V for the ion with m/z 400 and at approximately −0.4 V for the ion with m/z 100. Based on the relationship between the releasing DC voltage and the travel time previously determined by such a simulation or preliminary experiment, it is possible to appropriately set the releasing DC voltage according to the mass-to-charge ratio of the measurement target ion so as to practically eliminate the mass-to-charge-ratio dependency of the period of time required for the ions to reach the orthogonal accelerator 17.

At the point in time where the predetermined delay time has passed since the point of release of the ions from the ion guide 14 (i.e. collision cell 13), the orthogonal accelerator voltage generator 34 applies acceleration voltages to the pushing electrode 172 and extracting electrode 173, respectively. The delay time is a constant, which is previously determined according to the required travel time. When the accelerating voltages are applied in the orthogonal accelerator 17, the measurement target ion has already been introduced into the orthogonal accelerator 17 and is present within the space between the pushing electrode 172 and the extracting electrode 173, regardless of the mass-to-charge ratio of the measurement target ion. Therefore, in the Q-TOFMS of the present embodiment, the measurement target ion can be assuredly ejected into the flight space 20 and subjected to the mass spectrometry.

Figure 6:
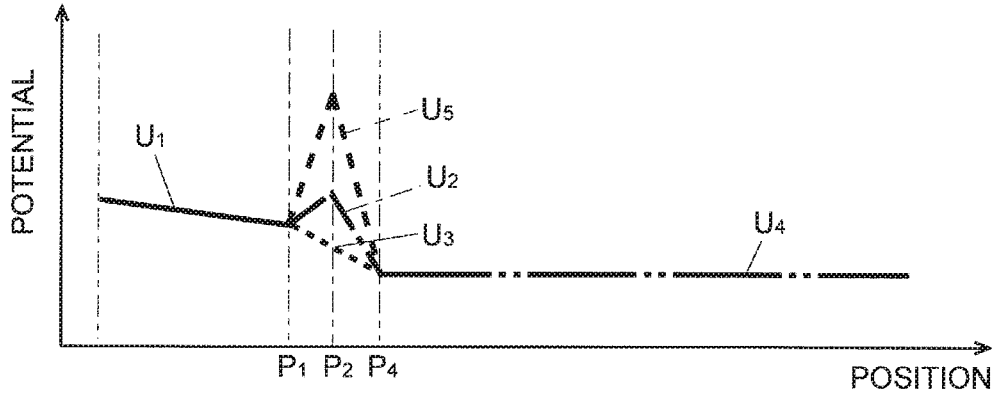
FIG. 6 is a schematic diagram of the potential distribution on the axis C in a Q-TOFMS as the second embodiment of the present invention.
Figure 7:
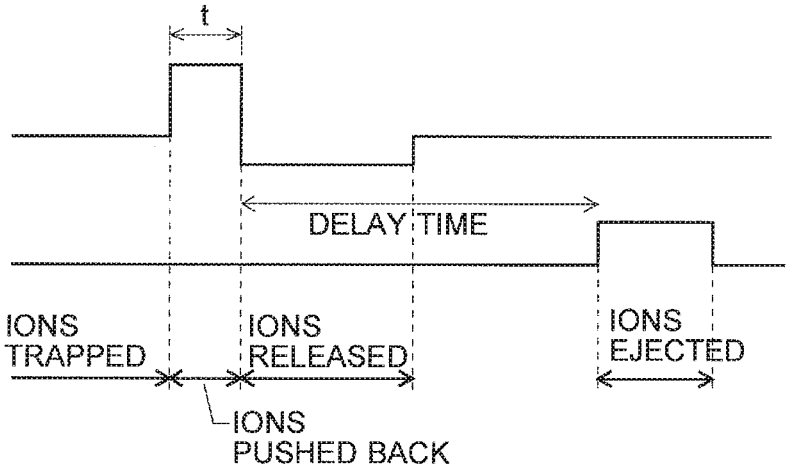
FIG. 7 is a timing chart of the voltage applied to the exit gate electrode and the voltage applied for orthogonal acceleration in the Q-TOFMS of the second embodiment.

Next, a Q-TOFMS as the second embodiment of the present invention is described with reference to the attached drawings. The overall configuration of the Q-TOFMS of the second embodiment is the same as that of the first embodiment; the difference from the first embodiment exists in the control performed by the controller 30 in some operations, such as the application of the voltage from the exit gate electrode voltage generator 32 to the exit gate electrode 132. The characteristic control operation in the Q-TOFMS of the second embodiment is described with reference to FIGS. 6 and 7. FIG. 6 is a schematic diagram of the potential distribution on the axis C, while FIG. 7 is a timing chart of the voltage applied to the exit gate electrode and the voltage applied for orthogonal acceleration.

In the Q-TOFMS of the second embodiment, when ions are trapped within the inner space of the ion guide 14, the ion guide voltage generator 31 applies, to each of the four rod electrodes constituting the ion guide 14, a voltage generated by adding a radio-frequency voltage and a DC voltage, while the exit gate electrode voltage generator 32 applies, to the exit gate electrode 132, a predetermined level of DC voltage that is higher than the voltage at the exit end of the ion guide 14. These operations are the same as in the first embodiment except that the voltage applied to the exit gate electrode 132 in this stage is fixed. The single-dotted chain line $U_2$ in FIG. 6 represents the potential distribution formed in this stage between the exit end (located at point $P_1$ in FIG. 2B) of the ion guide 14 and the first plate electrode (located at point $P_4$ in FIG. 2B) of the ion transport optical system 16. The potential barrier has a fixed height.

Subsequently, at a point in time which is earlier than the point of release of the ions from the inner space of the ion guide 14 by a predetermined length of time, the exit gate electrode voltage generator 32 increases the voltage applied to the exit gate electrode 132. The broken line $U_5$ in FIG. 6 represents the potential distribution formed by this operation. When the potential barrier is increased, the ions which are trapped within the inner space of the ion guide 14 and moving toward the exit end of the ion guide 14 are greatly pushed back, where an ion having a lower mass-to-charge ratio is pushed back to a closer position to the entrance end of the ion guide 14. The increased potential barrier is maintained for only a short period of time. Subsequently, the voltage applied to the exit gate electrode 132 is decreased to a lower level than the voltage at the exit end of the ion guide 14. The ions trapped within the inner space of the ion guide 14 are thereby released, where the ions start from different positions depending on their respective mass-to-charge ratios; ions having lower mass-to-charge ratios start from closer positions to the entrance end of the ion guide 14. In other words, the travel distance of the ions varies depending on their mass-to-charge ratios, as already explained. By appropriately setting the value of the voltage applied to push back the ions immediately before the release of the ions in the previously described manner (push-back voltage), it is possible to equalize, to some extent, the periods of time required for the travel of the ions with different mass-to-charge ratios so that the ions almost simultaneously reach the orthogonal accelerator 17. This fact is hereinafter described using a simulation result.

Figure 8:
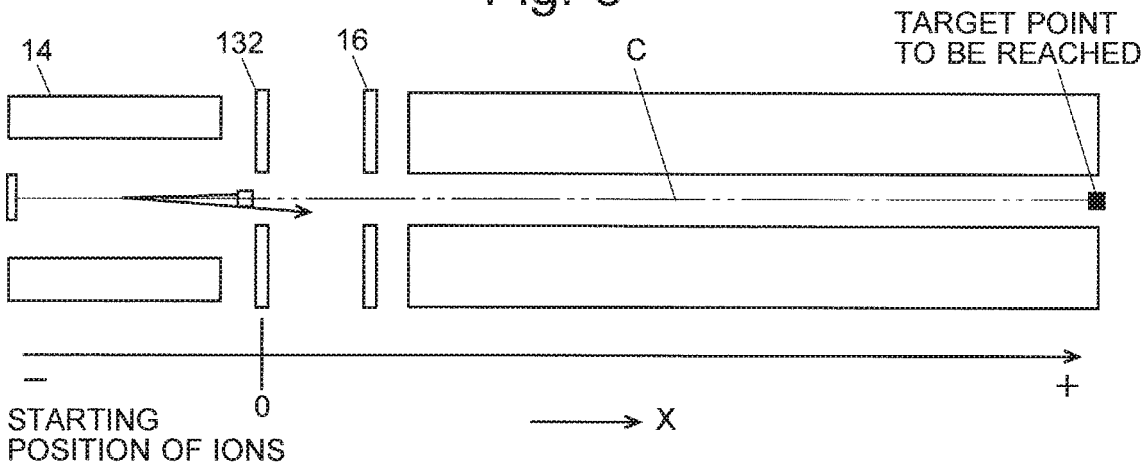
FIG. 8 is a configuration diagram assumed in a simulation calculation for the motion of an ion in the Q-TOFMS of the second embodiment.
Figure 9:
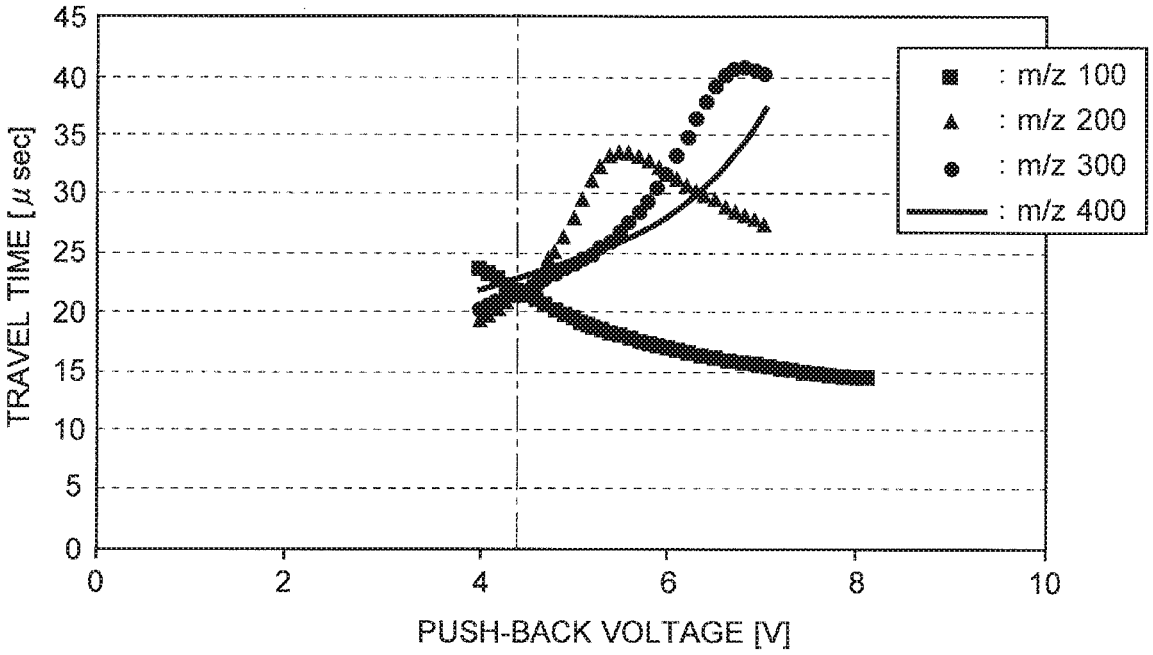
FIG. 9 is a chart showing the result of a simulation of the relationship between the push-back voltage and the travel time for ions with different mass-to-charge ratios.
Figure 10A:
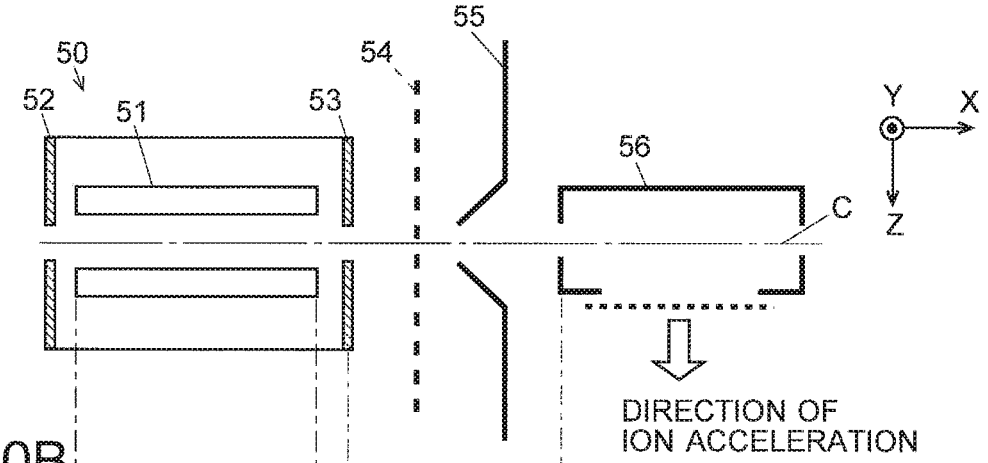
FIG. 10A is a detailed configuration diagram of the collision cell and the orthogonal accelerator in a conventional Q-TOFMS.
Figure 10B:
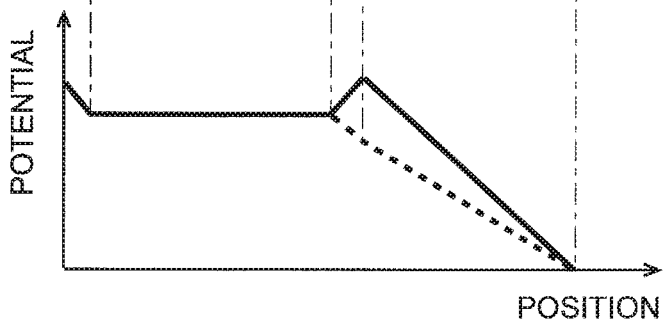
FIG. 10B is a chart showing the potential distribution on the axis C.
Figure 10C:
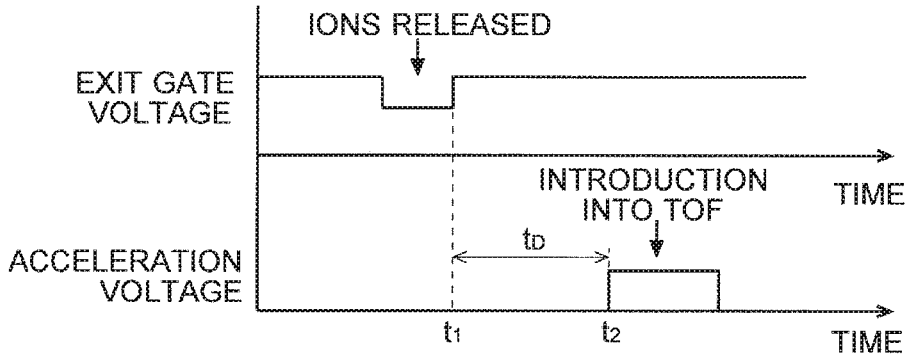
FIG. 10C is a timing chart of the voltage applied to the exit gate electrode and the orthogonal acceleration voltage.

FIG. 8 is a model configuration diagram assumed in a simulation calculation of the motion of the ion in the Q-TOFMS of the second embodiment. FIG. 9 is a chart showing the result of the simulation of the relationship between the push-back voltage and the travel time for ions with different mass-to-charge ratios. The period of time to apply the push-back voltage (indicated by tin FIG. 7) was set at 1.4 usec.

As described earlier, in the case where the ions are simply trapped within the inner space of the ion guide 14 before being released, the periods of time required for the travel of the ions are 8.19037 usec, 11.5829 usec, 14.1861 usec and 16.3807 usec for ions with m/z 100, m/z 200, m/z 300 and m/z 400, respectively. By comparison, when a push-back voltage of 4.2 V is applied, the periods of time required for the travel of the ions with m/z 100, m/z 200, m/z 300 and m/z 400 are 22.6295 usec, 20.0834 usec, 20.7912 usec and 22.2793 usec, respectively. Normally, the length of the area in which the ions are accelerated in the orthogonal accelerator 17 is approximately within a range from 30 mm to 40 mm. A few usec of difference in the travel time is permissible. This fact demonstrates that an appropriate setting of the push-back voltage makes it possible for a wide range of mass-to-charge ratios of the ions to be almost simultaneously introduced into the orthogonal accelerator 17 and accelerated within this orthogonal accelerator 17.

In this manner, in the Q-TOFMS of the second embodiment, not only ions having a specific mass-to-charge ratio but also ions included within a wide range of mass-to-charge ratios can be accelerated in the orthogonal accelerator 17 into the flight space 20 and subjected to a mass spectrometry. Therefore, a high-sensitivity mass spectrum covering a wide range of mass-to-charge ratios can be obtained with a single measurement.

The first and second embodiments were concerned with the case where the present invention was applied in a Q-TOFMS using an orthogonal acceleration TOFMS. The present invention can also be applied in a linear TOFMS or reflectron TOFMS using a three-dimensional quadrupole ion trap as the ion ejection source. In this case, the orthogonal accelerator 17 in the configuration of the first and second embodiments can be simply replaced by a three-dimensional quadrupole ion trap. That is to say, the system can be configured so that the ions which are released from the ion guide 14 (or collision cell 13) and pass through the ion transport optical system 16 are introduced through the ion injection opening of the three-dimensional quadrupole ion trap into the inside of the same ion trap. In this case, it is necessary to limit, to some extent, the time range in which the ions are introduced through the ion injection opening into the three-dimensional quadrupole ion trap. However, by using the configuration of the first embodiment, ions having a specific mass-to-charge ratio can be introduced into the ion trap with a high level of efficiency. Furthermore, by using the configuration of the second embodiment, ions included within a wider range of mass-to-charge ratios can be introduced into the ion trap.

It should be noted that any of the previous embodiments is an example of the present invention, and any change, modification, addition or the like appropriately made within the spirit of the present invention will evidently fall within the scope of claims of the present application.

REFERENCE SIGNS LIST

1 . . . Chamber
2 . . . Ionization Chamber
3, 4, 5 . . . Intermediate Chamber
6 . . . High-Vacuum Chamber
7 . . . ESI Spray Device
8 . . . Heated Capillary
9 . . . Ion Guide
10 . . . Skimmer
11 . . . Ion Guide
12 . . . Quadrupole Mass Filter
13 . . . Collision Cell
132 . . . Exit Gate Electrode
14 . . . Ion Guide
15 . . . Ion Passage Opening
16 . . . Ion Transport Optical System
17 . . . Orthogonal Accelerator
171 . . . Entrance Electrode
172 . . . Pushing Electrode
173 . . . Extracting Electrode
20 . . . Flight Space
21 . . . Reflector
22 . . . Back Plate
23 . . . Ion Detector

30 . . . Controller
31 . . . Ion Guide Voltage Generator
32 . . . Exit Gate Electrode Voltage Generator
33 . . . Ion Transport Optical System Voltage Generator
34 . . . Orthogonal Accelerator Voltage Generator
C . . . Ion Beam Axis

The invention claimed is:

1. An orthogonal acceleration time-of-flight mass spectrometer including an orthogonal accelerator for accelerating incident ions in an orthogonal direction to an axis of incidence of the ions and a separating-detecting section in which the accelerated ions are separated according to their mass-to-charge ratios and detected, the mass spectrometer further comprising:

a) an ion trap for temporarily trapping ions as measurement target ions and ejecting the ions toward the orthogonal accelerator, including an ion guide for converging ions into an area near an ion beam axis by a radio-frequency electric field and an exit gate electrode placed on an outside of an exit end of the ion guide;

b) a voltage supplier for applying a DC voltage to the exit gate electrode; and c) a controller for controlling the voltage supplier in such a manner that a trapping DC voltage which is higher than at least a potential at the exit end of the ion guide is applied to the exit gate electrode while trapping the measurement target ions within an inner space of the ion guide, and a releasing DC voltage which is lower than the potential at the exit end of the ion guide is applied to the exit gate electrode at a time of releasing the measurement target ions from the ion guide, where the controller changes the trapping DC voltage according to the mass-to-charge ratio or mass-to-charge ratio range of the measurement target ions and the trapping DC voltage pushes back the measurement target ions into the ion guide, wherein the trapping DC voltage is higher for the measurement target ion having a lower mass-to-charge ratio, and by which a higher potential barrier is formed for the measurement target ion having the lower mass-to-charge ratio.

2. An orthogonal acceleration time-of-flight mass spectrometer including:

a second ion trap for capturing incident ions by an effect of an electric field and subsequently imparting acceleration energy to the ions at a predetermined timing to eject the ions at substantially a same point in time; and a separating-detecting section in which the ions ejected from the second ion trap are separated according to their mass-to-charge ratios and detected, the mass spectrometer further comprising:

a) a first ion trap for temporarily trapping ions as measurement target ions and ejecting the ions toward the second ion trap, the first ion trap including an ion guide for converging ions into an area near an ion beam axis by a radio-frequency electric field and an exit gate electrode placed on an outside of an exit end of the ion guide;

b) a voltage supplier for applying a DC voltage to the exit gate electrode; and c) a controller for controlling the voltage supplier in such a manner that a trapping DC voltage which is higher than at least a potential at the exit end of the ion guide is applied to the exit gate electrode while trapping the measurement target ions within an inner space of the ion guide, and a releasing DC voltage which is lower than the potential at the exit end of the ion guide is applied to the exit gate electrode at a time of releasing the measurement target ions from the ion guide, where the controller changes the trapping DC voltage according to the mass-to-charge ratio or mass-to-charge ratio range of the measurement target ions and the trapping DC voltage pushes back the measurement target ions into the ion guide, wherein the trapping DC voltage is higher for the measurement target ion having a lower mass-to-charge ratio, and by which a higher potential barrier is formed for the measurement target ion having the lower mass-to-charge ratio.

3. The time-of-flight mass spectrometer according to claim 1, wherein:

the controller additionally changes the releasing DC voltage according to the mass-to-charge ratio or mass-to-charge ratio range of the measurement target ions.

4. An orthogonal acceleration time-of-flight mass spectrometer including an orthogonal accelerator for accelerating incident ions in an orthogonal direction to an axis of incidence of the ions and a separating-detecting section in which the accelerated ions are separated according to their mass-to-charge ratios and detected, the mass spectrometer further comprising:

a) an ion trap for temporarily trapping ions as measurement target ions and ejecting the ions toward the orthogonal accelerator, including an ion guide for converging ions into an area near an ion beam axis by a radio-frequency electric field and an exit gate electrode placed on an outside of an exit end of the ion guide;

b) a voltage supplier for applying a DC voltage to the exit gate electrode; and c) a controller for controlling the voltage supplier in such a manner that, while trapping the measurement target ions within an inner space of the ion guide, a potential distribution sloped downward in a travelling direction of the ions is formed in the ion guide, and a trapping DC voltage which is higher than at least a potential at the exit end of the ion guide is applied to the exit gate electrode, the DC voltage applied to the exit gate electrode is changed for a predetermined period of time so as to increase the potential at the exit gate electrode before releasing the measurement target ions from the ion guide while maintaining the radio-frequency electric field and the same potential distribution sloped downward in the travelling direction of the ions in the ion guide, and subsequently, a releasing DC voltage which is lower than the potential at the exit end of the ion guide is applied to the exit gate electrode while maintaining the radio-frequency electric field and the same potential distribution sloped downward in the travelling direction of the ions in the ion guide.

5. An orthogonal acceleration time-of-flight mass spectrometer including: a second ion trap for capturing incident ions by an effect of an electric field and subsequently imparting acceleration energy to the ions at a predetermined timing to eject the ions at substantially a same point in time; and a separating-detecting section in which the ions ejected from the second ion trap are separated according to their mass-to-charge ratios and detected, the mass spectrometer further comprising:

a) a first ion trap for temporarily trapping ions as measurement target ions and ejecting the ions toward the second ion trap, the first ion trap including an ion guide for converging ions into an area near an ion beam axis by a radio-frequency electric field and an exit gate electrode placed on an outside of an exit end of the ion guide;

b) a voltage supplier for applying a DC voltage to the exit gate electrode; and c) a controller for controlling the voltage supplier in such a manner that, while trapping the measurement target ions within an inner space of the ion guide, a potential distribution sloped downward in a travelling direction of the ions is formed in the ion guide, and a trapping DC voltage which is higher than at least a potential at the exit end of the ion guide is applied to the exit gate electrode, the DC voltage applied to the exit gate electrode is changed for a predetermined period of time so as to increase the potential at the exit gate electrode before releasing the measurement target ions from the ion guide while maintaining the radio-frequency electric field and the same potential distribution sloped downward in the travelling direction of the ions in the ion guide, and subsequently, a releasing DC voltage which is lower than the potential at the exit end of the ion guide is applied to the exit gate electrode while maintaining the radio-frequency electric field and the same potential distribution sloped downward in the travelling direction of the ions in the ion guide.

6. The time-of-flight mass spectrometer according to claim 1, wherein:

the ion trap is a linear ion trap placed within a collision cell which dissociates an ion.

7. The time-of-flight mass spectrometer according to claim 2, wherein:

the controller additionally changes the releasing DC voltage according to the mass-to-charge ratio or mass-to-charge ratio range of the measurement target ions.

8. The time-of-flight mass spectrometer according to claim 2, wherein:

the first ion trap is a linear ion trap placed within a collision cell which dissociates an ion.

9. The time-of-flight mass spectrometer according to claim 3, wherein:

the ion trap is a linear ion trap placed within a collision cell which dissociates an ion.

10. The time-of-flight mass spectrometer according to claim 4, wherein:

the ion trap is a linear ion trap placed within a collision cell which dissociates an ion.

11. The time-of-flight mass spectrometer according to claim 5, wherein:

the first ion trap is a linear ion trap placed within a collision cell which dissociates an ion.

12. The time-of-flight mass spectrometer according to claim 7, wherein:

the first ion trap is a linear ion trap placed within a collision cell which dissociates an ion.

* * * * *